US010744796B2

(12) United States Patent
McIntyre

(10) Patent No.: US 10,744,796 B2
(45) Date of Patent: Aug. 18, 2020

(54) IMAGE REPRODUCTION TECHNIQUE

(71) Applicant: Kevin A. McIntyre, Greer, SC (US)

(72) Inventor: Kevin A. McIntyre, Greer, SC (US)

( * ) Notice: Subject to any disclaimer, the term of this patent is extended or adjusted under 35 U.S.C. 154(b) by 7 days.

(21) Appl. No.: 16/399,067

(22) Filed: Apr. 30, 2019

(65) Prior Publication Data

US 2019/0351686 A1 Nov. 21, 2019

Related U.S. Application Data

(60) Provisional application No. 62/673,251, filed on May 18, 2018.

(51) Int. Cl.

| | |
|---|---|
| ***B41J 11/00*** | (2006.01) |
| ***B44F 11/00*** | (2006.01) |
| ***B41M 7/00*** | (2006.01) |

(52) U.S. Cl.

CPC ..... *B41J 11/0015* (2013.01); *B41M 7/00* (2013.01); *B44F 11/00* (2013.01)

(58) Field of Classification Search

CPC ..... B41J 11/0015; B44F 11/00; B41M 7/00
USPC ..... 347/2, 3, 100, 101
See application file for complete search history.

(56) References Cited

U.S. PATENT DOCUMENTS

| | | | | |
|---|---|---|---|---|
| 1,050,236 | A | 1/1913 | Schmitt | |
| 2,068,204 | A | 1/1937 | Smith | |
| 4,505,944 | A | 3/1985 | Turner | |
| 8,708,440 | B2 * | 4/2014 | Nagase | B41J 2/0057 347/6 |
| 9,776,430 | B2 | 10/2017 | Swei et al. | |
| 9,815,312 | B2 * | 11/2017 | Pal | B41M 5/502 |
| 2003/0067529 | A1 | 4/2003 | May et al. | |
| 2005/0195261 | A1 | 9/2005 | Stelter et al. | |

OTHER PUBLICATIONS

Elmer W. Zimmerman; Iron Gallate Inks—Liquid and Powder; Research Paper RP807; Part of Journal of Research of the National Bureau of Standards, vol. 15, Jul. 1935.
Elmer Eusman; Manufacture of Ink; The Iron Gall Ink Website; https://irongallink.org.igi_index048a.html; 1988.

(Continued)

*Primary Examiner* — An H Do
(74) *Attorney, Agent, or Firm* — Joseph T. Guy; Patent Filing Specialist, Inc.

(57) ABSTRACT

A method for forming an image reproduction is detailed. The method includes: providing a media comprising a first side and a second side wherein the second side is opposite the first side;

printing a stock image to be reproduced on the first side with ink from an ink-jet printer to form an image precursor;

covering the image precursor with an excess of dry tannin powder wherein a portion of the dry tannin powder adheres to the stock image as imaging tannin and a remainder of the dry tannin powder is unaltered dry tannin powder;

removing the unaltered dry tanning powder; and placing an aqueous solution of an iron salt on the second side opposite the imaging tannin wherein the iron salt migrates through the media to convert the imaging tannin into the image reproduction wherein the image reproduction replicates the stock image.

19 Claims, 1 Drawing Sheet

(56) References Cited

OTHER PUBLICATIONS

Antonio Da Costa et al.; Scanning Electron Microscopic Characterization of Iron-Gall Inks from Different Tannin Sources—Applications for Cultural Heritage; 2014.
Hue P. Le et al.; Progress and Trends in Ink-Jet Printing Technology; Journal of Imaging Science and Technology; vol. 42, No. 1; Jan./Feb. 1998.

* cited by examiner

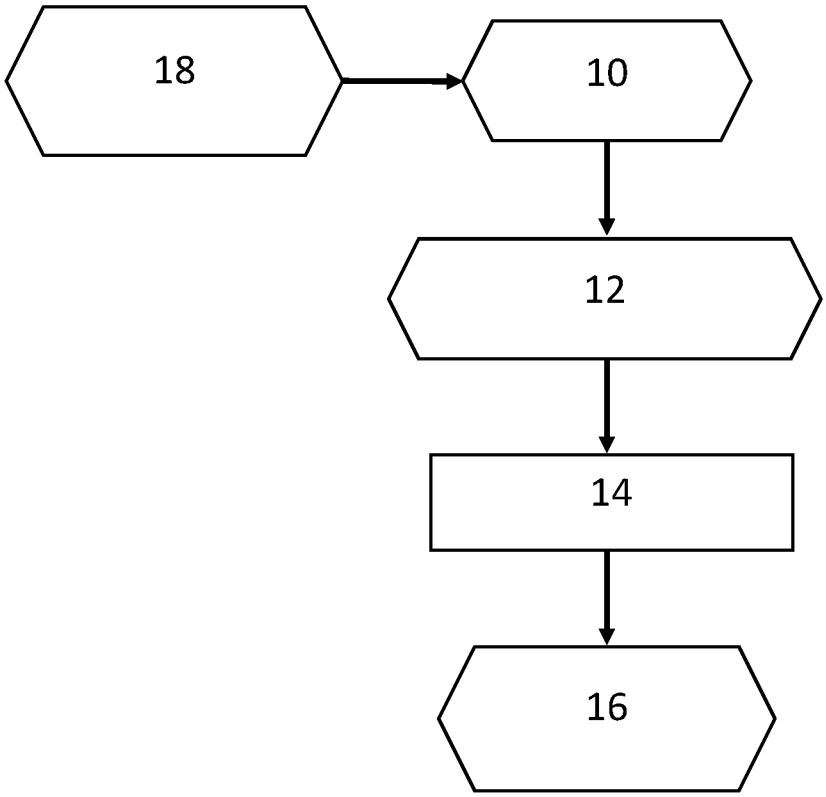
18
10
12
14
16

IMAGE REPRODUCTION TECHNIQUE

CROSS-REFERENCE TO RELATED APPLICATIONS

The present application claims priority to U.S. Provisional Patent Application No. 62/673,251 filed May 18, 2018 which is incorporated herein by reference.

BACKGROUND

The present invention is related to methods for forming image reproductions which mimic legacy stock images using modern printers and inks. More specifically, the present invention provides a method for forming an image reproduction utilizing iron gall ink printing methods coupled with ink jet image production methods. More specifically, the present invention is related to image reproduction techniques wherein a, preferably legacy, stock image is reproduced to provide an image reproduction which mimics the stock image yet the image has an iron gall ink appearance suggestive of an original.

Many legacy images are electronically available to the public as stock images. These images can be downloaded and printed using modern printing techniques, such as by an ink jet printer, to be enjoyed by a new generation. Unfortunately, the printed images have a relatively flat appearance without the character associated with ancient printing techniques such as iron gall printing. Iron gall printing provides a hue and depth which is unique yet the cost of reproduction using iron gall printing is not financially feasible and the image durability is not suitable.

It has long been the desire of art enthusiast to recapture legacy images in some form which is representative of iron gall printing without the effort and cost associated with actually printing a true iron gall image. It has long been the desire of art enthusiast to replicate stock images, particularly legacy images, cheaply using modern printers while achieving the visual effect associated with an ink gall images.

The present invention provides an image reproduction technique, utilizing conventional ink jet printing and printers, with a treatment process wherein the image is transformed to one having a visual effect similar to an original ink gall image.

SUMMARY OF THE INVENTION

The invention relates to an improved image reproduction technique wherein an image can be printed with an ink jet printer, using ink jet inks, and the image is transformed to one having iron gall imaging effects.

A particular feature of the invention is the ability to reproduce images quickly, and with limited expense, wherein the image has the effect of a historical image.

These and other embodiments, as will be realized, are provided in a method for forming an image reproduction. The method includes:

providing a media comprising a first side and a second side wherein the second side is opposite the first side;

printing a stock image to be reproduced on the first side with ink from an ink-jet printer to form an image precursor;

covering the image precursor with an excess of dry tannin powder wherein a portion of the dry tannin powder adheres to the stock image as imaging tannin and a remainder of the dry tannin powder is unaltered dry tannin powder;

removing the unaltered dry tanning powder; and placing an aqueous solution of an iron salt on the second side opposite the imaging tannin wherein the iron salt migrates through the media to convert the imaging tannin into the image reproduction wherein the image reproduction replicates the stock image.

BRIEF DESCRIPTION OF FIGURE

FIGURE is a flow chart representation of the invention.

DESCRIPTION

The present invention is related to an image reproduction technique wherein an image can be printed using an ink jet printer, utilizing ink jet inks, and the image is then transformed to include an iron gall image mimicking the ink jet image thereby providing a pleasing effect.

The technique for image reproduction will be described with reference to the FIGURE which forms an integral, but non-limiting, part of the specification. The technique includes the steps of:

printing a stock image, 10, from an ink jet printer, using an ink jet ink, onto a first side of a media;

adding an excess of tannin onto the stock image, 12, within a first time wherein a portion of the tannin adheres to the ink of the stock image as imaging tannin and the remainder of the tannin is unaltered tannin;

removing the unaltered tannin from the media, 14; and placing an aqueous solution of an iron salt on a second side of the media, opposite the first side, 16, wherein the iron salt migrates through the media to convert the imaging tannin into an image reproduction.

In one embodiment a mixture of tannin, iron salts and burnt plate oil can be applied to the paper and dried, 18, prior to the inkjet printing. The mixture is activated by the water in the inkjet ink thereby initiating a reaction at contact which extends the working time for application of the tannin.

The media is preferably a planar sheet of, preferably, paper. The thickness, density and composition of the media is not particularly limited with the exception of being suitable for printing with ink jet ink and allowing the iron salt to migrate there through. Woven papers are suitable with high cellulose papers being particularly preferred with cotton, linen and others being suitable for demonstration of the invention. It is most preferable that the paper be relatively free of metals, particularly iron, which can interfere with the image reproduction process. For the purposes of clarity the media is arbitrarily described as having a first side, which is the side the image is printed on, and a second side, which is opposite the first side and the side treated with iron solution.

The ink jet printer is not particularly limited. It is preferable that the ink jet printer be compatible with a pigment-based ink, and particularly a metal containing pigment, either as part of the black ink or as a component of the ink forming the black ink. Color images can be reproduced, however, a large majority of the stock images, and particularly the legacy stock images, were iron gall ink images and therefore black images. A Canon Pixma M330 using Canon 210 XL Black Ink (PPE-PS-GF25) is particularly suitable for demonstration of the invention due to the low purchase cost, ready availability and relatively low cost of operation.

The ink jet ink is preferably a pigment based ink, as opposed to a dye based ink, with particularly preferred pigments containing a metal. Pigments comprising at least one of cobalt, nickel, aluminum, zinc and magnesium are preferred with cobalt and nickel being most preferred. Spinets are a particularly preferred pigment with spinels comprising cobalt and nickel being particularly preferred. Rutile is a particularly suitable pigment which can be applied to the paper prior to the iron salts wicking to the inkjet ink.

Tannin is a natural material extracted from plants and algae. Powdered tannin is particularly preferred. Particularly preferred tannins for demonstration of the invention are hydrolysable tannins, phlorotannins and phlobatannis. Hydrolyzable tannins are particularly suitable with gallic acid and gallic acid derivatives being most preferred.

The image as printed on the paper, and before application of tannin, is referred to herein as an image precursor. It is preferable that sufficient tannin be applied to cover the image precursor with excess tannin. The process for applying the tannin is not particularly limiting. A process which is particularly suitable is to apply the tannin by slowly pouring, also referred to as dusting, the powdered tannin over the image. In places with no image the tannin should remain as unaltered dry tannin powder. In places with an image precursor present tannin will adhere to the precursor image and the adhered tannin is referred to herein as imaging tannin. It is preferably that the tannin be applied within five (5) minutes and more preferably within two (2) minutes after formation of the image precursor.

The unaltered dry tannin powder can be removed by any means suitable with the proviso that that the imaging tannin is not disturbed. The unaltered dry tannin can be removed by an air flow, brushing or, most preferably, by inverting the media such that the second side is upward thereby allowing the unaltered dry tannin powder to fall from the first side. It is preferable to capture the unaltered dry tannin powder for subsequent use.

In an embodiment an enhanced tannin can be used wherein the enhanced tannin comprises a mixture of tannin and a dry powder selected from pigment, minerals, bone, vegetable matter, metals and inert materials. Particularly preferred dry powders are selected from the group consisting of organic pigments, inorganic pigments, geological regolith simulants, Prussion blue and garnet. The dry powder has a preferred particle size of about 79 microns or less or the particles pass through a No. 200 sieve. The weight ratio of tannin to dry powder is preferably at least 1.5:1 to no more than about 5:1. More preferably the weight ratio of tannin to dry powder is at least 2.5:1 to no more than about 3.5:1. The particle size of the dry powder can be reduced, if necessary, by any suitable means including a tumbler attached to an oscillating table with a rotation/oscillation ratio sufficient to reduce the particle size in a reasonable time. A rotation/oscillation ratio of unity is sufficient to demonstrate the invention.

The aqueous solution of iron salt preferably comprises iron in a +3 or +2 oxidation state. $Fe_2(SO_4)_3$, $FeSO_4$, $FeCL_2$ or $FeCl_3$ are imminently suitable for demonstration of the invention. The preferred aqueous solution comprises $FeSO_4$.

The aqueous solution of iron salt is added to the second side of the media opposite the imaging tannin. Without being limited to theory, it is hypothesized that the iron and tannin form a complex thereby essentially fixing the image. The manner in which the aqueous solution of iron salt is applied to the media is not particularly limited.

After application of the iron salt it is preferable to dry the media to remove any excess water. Excess water can cause the media to become non-planer thereby distorting the image which can become unsightly. Drying is optional and the method of drying is not limited. A standard device utilizing forced air over a heating element is suitable such as a hair dryer or air gun.

After the media is dry it is preferable to press the printed media between two platens to remove any undulations in the media. Glazes can be employed to the image reproduction. Particularly preferred glazes include linseed oil, shellac and microcrystalline wax.

The invention has been described with reference to the preferred embodiments without limit thereto. One of skill in the art would realize additional embodiments and alterations which are not specifically recited herein but which are within the scope of the invention as set forth in the claims appended hereto.

The invention claimed is:

1. A method for forming an image reproduction comprising:

providing a media comprising a first side and a second side wherein said second side is opposite said first side;

printing a stock image to be reproduced on said first side with ink from an ink-jet printer to form an image precursor;

applying an excess of dry tannin powder to said image precursor wherein a portion of said dry tannin powder adheres to said stock image as imaging tannin and a remainder of said dry tannin powder is unaltered dry tannin powder;

removing said unaltered dry tanning powder; and placing an aqueous solution of an iron salt on said second side opposite said imaging tannin wherein said iron salt migrates through said media to convert said imaging tannin into said image reproduction wherein said image reproduction replicates said stock image.

2. The method for forming an image reproduction of claim 1 wherein said media comprises cellulose.

3. The method for forming an image reproduction of claim 1 wherein said ink comprises pigment.

4. The method for forming an image reproduction of claim 3 wherein said pigment comprises a metal selected from the group consisting of cobalt, nickel, aluminum, zinc and magnesium.

5. The method for forming an image reproduction of claim 4 wherein said metal is selected from the group consisting of cobalt and nickel.

6. The method for forming an image reproduction of claim 3 wherein said pigment comprises a spinel.

7. The method for forming an image reproduction of claim 6 wherein said spinel comprises cobalt or nickel.

8. The method for forming an image reproduction of claim 3 wherein said pigment is rutile.

9. The method for forming an image reproduction of claim 1 wherein said tannin is selected from the group consisting of hydrolysable tannin, phlorotannin and phlobatanni.

10. The method for forming an image reproduction of claim 9 wherein said tannin is gallic acid or a derivative of gallic acid.

11. The method for forming an image reproduction of claim 1 wherein said iron salt comprises a salt of $Fe^{2+}$ or $Fe^{3+}$.

12. The method for forming an image reproduction of claim 11 wherein said iron salt is selected from the group consisting of $Fe_2(SO_4)_3$, $FeSO_4$, $FeCL_2$ or $FeCl_3$.

13. The method for forming an image reproduction of claim 1 wherein said aqueous solution is placed prior to said applying said excess of dry tannin powder.

14. The method for forming an image reproduction of claim 1 wherein said tannin is an enhanced tannin further comprising a dry powder.

15. The method for forming an image reproduction of claim 14 wherein said dry powder is selected from the group consisting of pigment, mineral, bone, vegetable matter, metal and inert material.

16. The method for forming an image reproduction of claim 14 wherein said dry powder is selected from the group consisting of organic pigments, inorganic pigments, geological regolith simulants, Prussion blue and garnet.

17. The method for forming an image reproduction of claim 14 wherein said dry powder has a particle size of no more than 79 microns.

18. The method for forming an image reproduction of claim 14 wherein said enhanced tannin comprises a weight ratio of tannin to dry powder of at least 1.5:1 to no more than 5:1.

19. The method for forming an image reproduction of claim 18 wherein said weight is at least 2.5:1 to no more than 3.5:1.

* * * * *